United States Patent [19]

Wolff

[11] Patent Number: 4,596,212

[45] Date of Patent: Jun. 24, 1986

[54] METHOD AND APPARATUS FOR REDUCING THE VOLUME OF FLUID IN A FLUID COOLED ENGINE

[76] Inventor: Frederick W. Wolff, 1701 S. Filbert St., Allentown, Pa. 18103

[21] Appl. No.: 654,781

[22] Filed: Sep. 26, 1984

[51] Int. Cl.[4] ..... F01P 3/02

[52] U.S. Cl. ..... 123/41.72; 123/41.5

[58] Field of Search ..... 123/41.42, 41.5, 41.72, 123/41.74, 41.01, 195 R; 252/71; 264/42

[56] References Cited

U.S. PATENT DOCUMENTS

| | | | |
|---|---|---|---|
| 1,316,912 | 9/1919 | Marschall | 123/41.42 |
| 2,194,000 | 3/1940 | Arnold | 123/41.72 |
| 3,758,652 | 9/1973 | Jebens | 264/42 |
| 4,250,953 | 2/1981 | Bush | 123/41.16 |

*Primary Examiner*—William A. Cuchlinski, Jr.
*Attorney, Agent, or Firm*—James C. Simmons

[57] ABSTRACT

Rigid foam insert for decreasing the volume and weight of coolant required for the fluid jacket of a fluid cooled internal combustion engine.

2 Claims, 1 Drawing Figure

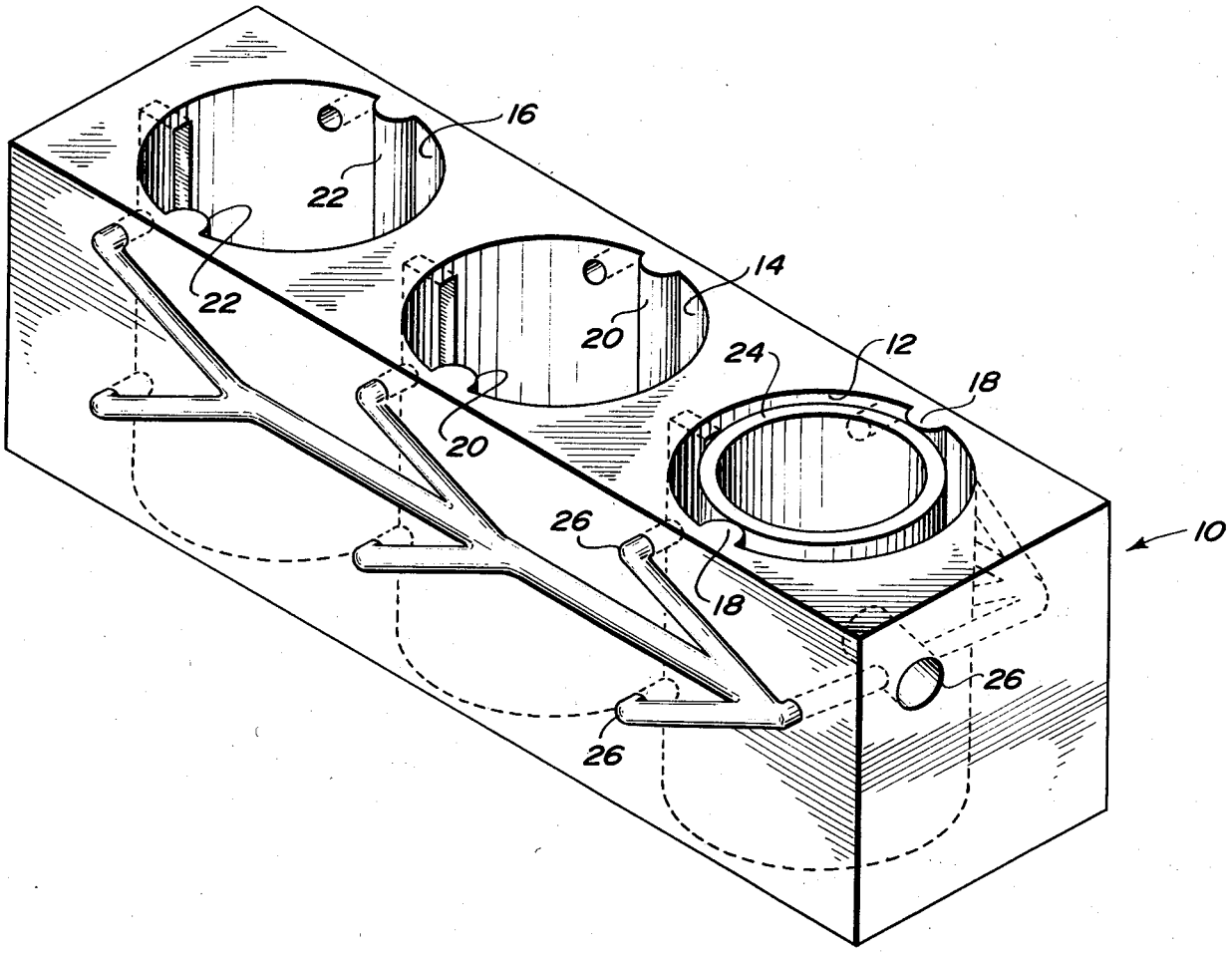
10
12
14
16
18
20
22
24
26

METHOD AND APPARATUS FOR REDUCING THE VOLUME OF FLUID IN A FLUID COOLED ENGINE

Field of the Invention

This invention relates to fluid cooled internal combustion engines and in particular to reducing the total volume of fluid necessary to cool an operating engine.

Background of the Invention

Conventional gasoline or diesel internal combustion engines such as used in motor vehicles rely upon fluid cooling to prevent high temperatures from combustion of the fuel destroying the engine. Convention cooling fluids include water and synthetic coolants which will not freeze when the ambient temperature is below 32° F. (0° C.). The coolant volume adds to the overall weight of the car which affects the mileage rating of the engine. Conventional water jackets can become fouled and cause localized hot spots in the cylinder walls. Furthermore, conventional water jackets require freeze out plugs to protect the engine.

Summary of the Invention

In accord with the present invention an inorganic substantially liquid and vapor impervious foam is formed and then placed inside the fluid cooling jacket of the engine to decrease the total fluid capacity of the cooling jacket. If necessary passages can be formed inside the foam to direct fluid to specific portions of the cylinder walls.

Brief Description of the Drawing

The single FIG. of the drawing is an isometric view of an apparatus according to the invention.

Description of the Preferred Embodiment

Conventional internal combustion engines such as used in motor vehicles and stationary power plants are fluid cooled to prevent the heat generated by the combustion of a fuel-air mixture from destroying the engine. Most engines require a large volume of coolant (e.g. water or water-synthetic coolant mixtures) which adds to the weight of the engine.

In applicants co-pending U.S. Patent Application Ser. No. 635,370 filed July 27, 1984 there is disclosed an engine block fabricated from hot formed structural shapes.

As with conventional cast iron or cast steel blocks a large fluid jacket is provided to cool the finished engine during normal operation. Automobile manufacturers are constantly seeking ways to reduce the weight of the automobile to, inter-alia, improve fuel economy. One way this can be done is to reduce the total weight of coolant required for a given size engine.

Applicant has discovered that in the case of an engine fabricated from structural shapes an insert such as shown in the drawing can be fabricated from an inorganic rigid foam such as FOAMSIL-28 sold by Pittsburgh Corning Corporation of Pittsburgh, Pa. 15239. This particular foam is generally impervious to liquids and liquid vapors with resistance to acids, solvents and weak bases over a wide temperature range.

As shown in the drawing engine block insert 10 is fabricated from the foam described above. Insert 10 shows vertical generally cylindrical shaped bores 12, 14, 16 with a plurality of ribs or spacers 18, 20, 22 formed in the vertical wall of bores 12, 14, 16. Spacers 18, 20, 22 position cylinder liners in bores 12, 14, 16 one of which is shown as 24 to define a space for fluid to circulate between insert 10 and cylinder liner 24. Insert 10 includes internal passages such as shown at 26 to conduct coolant to hot spots normally found in an internal combustion engine. Engine block insert 10 can be fabricated and assembled into an engine fabricated from structural shapes. Cast engine blocks can be fitted with pre-cast insert shapes or the insert can be foamed in place by techniques that include allowing for spacing between the foam and the cylinder walls.

Inserts according to the present invention present weight savings, temperature control benefits and sound insulation benefits to the engine manufacturers. Since the coolant jacket volume is decreased there is less coolant weight thus effecting a cost saving per engine. The insert with passages provides for more uniform cooling since coolant can be directed at normal hot spots which would otherwise distort cylinder walls. Thus, normal distribution tubes in a standard block would not be required.

The insert would compress if the coolant froze so that the block would not freeze thus eliminating the need for freeze-out plugs in the block.

It is well known that internal combustion engines and in particular diesel engines are noisy. Inserts according to the present invention would reduce the operating noise level.

With the engine insert of foam the engine would warm up more rapidly. As the engine warms up more rapidly the choke would open sooner thus saving fuel. In the winter defrosting would be more rapid. On the other hand, after use the engine would cool off slowly to keep the choke open longer to save fuel and facilitate restarts.

Having thus described my invention what is desired to be secured by letters patent of the United States is set forth in the appended claims.

I claim:

1. In an internal combustion engine of the type having a cylinder for combusting a fuel-air mixture and having a closed system including a fluid jacket to enable a fluid to circulate around and cool said cylinder the improvement comprising:

an inorganic substantially liquid and vapor impervious foam disposed throughout a substantial portion of said fluid jacket, whereby the fluid capacity of said fluid jacket is reduced without imparing the cooling capacity of the reduced fluid in said fluid jacket.

2. An apparatus according to claim 1 wherein there are included internal passages in the foam to direct coolant to specific locations to said cylinder.

* * * * *